US009046318B2

(12) United States Patent
Zumbo et al.

(10) Patent No.: US 9,046,318 B2
(45) Date of Patent: Jun. 2, 2015

(54) PLATFORM FINGER TAB WITH FINGER LOOPS

(76) Inventors: Matthew J. Zumbo, Fountain Valley, CA (US); Gary S. Zumbo, Fountain Valley, CA (US)

( * ) Notice: Subject to any disclaimer, the term of this patent is extended or adjusted under 35 U.S.C. 154(b) by 625 days.

(21) Appl. No.: 13/135,212

(22) Filed: Jun. 29, 2011

(65) Prior Publication Data

US 2013/0000007 A1 Jan. 3, 2013

(51) Int. Cl.
*A63B 71/14* (2006.01)
*F41B 5/14* (2006.01)

(52) U.S. Cl.
CPC ..... *F41B 5/1473* (2013.01)

(58) Field of Classification Search
CPC ..... F41B 5/1473
USPC ..... 2/16, 20, 21, 159, 160, 161.1, 161.5, 2/163, 167; 124/35.2; 482/44, 47–49
See application file for complete search history.

(56) References Cited

U.S. PATENT DOCUMENTS

| | | | | | |
|---|---|---|---|---|---|
| 2,974,319 | A | * | 3/1961 | Wilson et al. | 2/21 |
| 3,224,009 | A | | 12/1965 | Hoyt, Jr. | |
| 3,246,338 | A | | 4/1966 | Miller | |
| 3,608,090 | A | | 9/1971 | Wilson et al. | |
| 3,845,504 | A | | 11/1974 | Killian | |
| 4,097,931 | A | | 7/1978 | Hirose | |
| 4,332,233 | A | | 6/1982 | Knoble | |
| 4,620,524 | A | * | 11/1986 | Saunders | 124/35.2 |
| 5,131,095 | A | | 7/1992 | D'Amato | |

* cited by examiner

*Primary Examiner* — Amy Vanatta
*Assistant Examiner* — Sally Haden
(74) *Attorney, Agent, or Firm* — Albert O. Cota

(57) ABSTRACT

An archery finger tab (10) for a bowstring is taught, which consists of a tab face (20) having an index finger portion (26), a middle and ring finger portion (28) and a U-shaped slot (30). A backing member (36) is juxtaposed beneath the tab face and has the same configuration as the tab face. A mounting plate (38) is attached jointly to a rear edge of the tab face and the backing member, with the mounting plate having plurality of strap receiving slots (32). The mounting plate has a finger spacer (44) attached beneath the U-shaped slots in the tab face and backing member, and includes a snap buckle (56) attached on top of the mounting plate. A finger retaining strap (64) is attached to the mounting plate adjacent to the mounting plate forward edge and forms an index finger loop (66), a middle finger loop (68) and a ring finger loop (70). The strap (64) ends when attached to the snap buckle (56).

7 Claims, 4 Drawing Sheets

PLATFORM FINGER TAB WITH FINGER LOOPS

TECHNICAL FIELD

The invention generally pertains to archer's finger tabs and more specifically to a platform tab having an upward-angled tapered finger spacer and a single adjustable strap for retaining two or three fingers.

BACKGROUND OF THE INVENTION

Previously, many types of finger tabs have been used to provide an effective means for protecting an archer's fingers when releasing an arrow from a bowstring. In most cases the finger tab is simple and grips only a single finger to retain the tab after the arrow has been released.

A search of the prior art did not disclose any patents that possess the novelty of the instant invention; however the following U.S. patents are considered related:

| Patent Number | Inventor | Issue Date |
|---|---|---|
| 3,246,338 | Miller | Apr. 19, 1966 |
| 3,608,090 | Wilson et al. | Sep. 28, 1971 |
| 3,845,504 | Killian | Nov. 5, 1974 |
| 4,097,931 | Hirose | Jul. 4, 1978 |
| 4,332,233 | Knoble | Jun. 1, 1982 |
| 5,131,095 | D'Amato | Jul. 21, 1992 |

Miller in U.S. Pat. No. 3,246,338 teaches an archer's finger tab employing a strip of elasticized fabric formed as a loop. The loop is attached to the base portion of the tab projecting from the rear face to receive the middle finger.

U.S. Pat. No. 3,608,090 issued to Wilson et al. provides a tab that includes a flexible finger covering adapted to overlie an archer's fingers when gripping a bowstring. A slot in the covering secures the archer's hands in a predetermined position with the slot registered in alignment with two fingers. A pair of flaps opposite the slot protrude between the same two fingers. A single thong attached around the middle finger retains the tab after releasing the arrow.

Killian in U.S. Pat. No. 3,845,504 discloses a finger tab with a flexible tab projecting forwardly from an elongated base. The width of the tab is dimensioned to be interposed between the bow string and the two middle fingers, and the end projections are arranged to engage the index and little fingers. An elastic retaining strap secures the finger tab on the hand.

Hirose in U.S. Pat. No. 4,097,931 teaches a finger tab with one or more raised strips at a portion or portions corresponding to the first joint or joints of the middle and/or ring fingers. Pulling the bow string is facilitated by engaging the tab with one of the sides of the raised strips.

U.S. Pat. No. 4,332,233 issued to Knoble is for an archer's hand plate consisting of a base fitting the palm of an archers hand to keep the back of the hand flat and in line with fingers up to the first joint while maintaining the knuckles in line with the base plate.

D'Amato in U.S. Pat. No. 5,131,095 discloses a tab with a one piece blank having a first string facing panel which is connected by a pair of bands at opposite sides of the first panel to second and third finger panels. The finger panels are rotated through 360 degrees to superimpose and connect them to the first panel at connection areas on the panels which are space away from the finger tip and string engaging portion of the tab. A thong is connected to a hole extending in the connection area which engages the wrist retaining the tab onto the hand when the bow string is released.

For background purposes and as indicative of the art to which the invention is related reference may be made to the remaining cited U.S. Pat. No. 3,224,009 issued to Hoyt Jr.

BRIEF SUMMARY OF THE INVENTION

Simple one piece finger tabs used in archery to protect an archer's fingers when releasing the bowstring have been in common usage for countless decades. Currently, the most common tab has a split approximately one third down the leading edge of the tab so that one finger can be placed above and two fingers below the knocking point of the arrow, which is commonly known as the Mediterranean draw. However, more complex tabs or platform tabs have been developed for recurve and principally Olympic class target archery. The tab includes a platform attached to the back of the tab, thereby forming a flat cover over the top to give the archer a rigid reference point underneath the chin when the bowstring is at full draw.

In view of the above disclosure, the primary object of the invention is to provide a finger tab that permits firm attachment of the fingers in a parallel finger alignment. This arrangement completely eliminates any forward movement or angular placement of the tab on the archer's hand when the arrow is released. This object is accomplished by the utilization of an innovative design of each individual component of the instant invention.

An important object of the invention is that the mounting plate is small enough to conform to the shape of the archer's palm, thereby permitting the archer to close their hand sufficiently when wearing the finger tab to pull an arrow and even to write with a pen or pencil without discomfort. The mounting plate is further positioned to be placed low in the hand, allowing a positive anchor connection with the index finger and the jaw bone at full draw and anchor.

Another object of the invention is the overall configuration of the finger tab which permits one size to fit all as the mounting plate is small and the tab face and backing members are oversized, thereby permitting an archer to layout and customize the configuration of the tab to fit his or her hand size by trimming the tab to facilitate an optimum size considering the archer's individual style.

Still another object of the invention is an innovative spacer which is completely different than the prior art in present use. For decades a spacer has simply been a rectangular block, however the invention's spacer is longer in length which allows it to follow the natural hook of the shooter's fingers when grasping the bowstring, thereby bringing the trailing end of the spacer closer to the arrow nock. The spacer configuration further allows the spacer to be squeezed between the fingers by the ⅜ inch wide strap, forcing the finger parallel eliminating pinching of the arrow nock. The spacer's trailing end is attached to the flat mounting plate with the spacer's leading end and has an upward angle of 30 degrees. The use of the 30 degree angle positions the finger spacer closer to the archer's arrow nock at full draw which overcomes hand torque from the weight of the bow string on the archer's fingers. During the draw and at anchor, the weight of the bow has the tendency to torque the fingers to allow for alignment of the finger tips with the wrist and forearm. The spacer is configured to take into account the torque on the tab plate and is angled toward the arrow nock such that the finger tips remain parallel, disallowing the so-called "nock pinch".

Yet another object of the invention is its robust and attractive general appearance, as the mounting plate can be anodized with a myriad of selected colors, and the tab face is high quality cordovan leather with a grain orientated top surface which is not only long wearing but is oriented in the direction of the arrow travel. The spacer is formed of a black thermoplastic resin that accentuates the black color of the suede backing. The snap buckle and mounting hardware are made of stainless steel, with a finger retaining strap made of black nylon webbing of leather.

A further object of the invention is directed to the strapping arrangement that holds the archer's fingers comfortably against a suede surface of the backing member. A finger retaining strap, preferably a single piece of ⅜ inch wide nylon webbing, or leather, is attached to the mounting plate with a screw fastener adjacent to the mounting plate forward edge and penetrates the plate, face and backing, thereby forming an index finger loop beneath. The strap threads through a slot in the spacer and forms a middle finger loop and a ring finger loop ending by entering and being captured by a snap buckle. The finger tab loops are individually adjusted to conform to each separate finger allowing a firm and positive attachment to the archer's hand, thus preventing the tab from sliding forward at release. The snap buckle is the non-slip positive locking type consisting of a snap-in cover and a base including gripping teeth configured to penetrate and retain the strap. A depressed rib in the top of the cover insures a positive snap of lock of the buckle over the ⅜ inch strap preventing the buckle from opening at the release of the bow string.

Other objects of the invention are the optional features such as a right angle chin reference point ledge attached to the mounting plate and numerous buckle placement options. The ledge has an attachment slot and incorporated 90 degree right angle chin mating platform. The ledge is easily attached to the mounting plate with screw fasteners either by the manufacturer or may be added later by the user. Normally the buckle is mounted on the plate on the left side, for right hand shooters and the right side for left hand shooters in either three or two finger attachment when desired; alternatively the buckle may be mounted inboard for the two finger arrangement. Two opposed buckles may also be utilized in either finger arrangement. All parts are right and left hand interchangeable.

A final object is the adaptability of the invention to accommodate very small children with an optional platform finger tab with finger loops in miniature which is identical to the preferred embodiment except in a smaller scaled physical size.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 7:
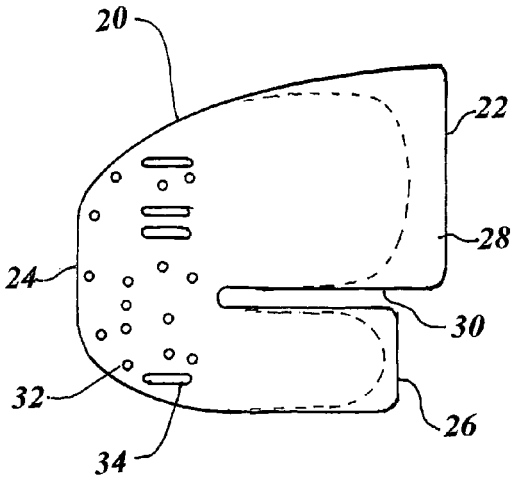
FIG. 7 is a top view of the tab face in the preferred embodiment.

The best mode for carrying out the invention is presented in terms that disclose a preferred embodiment of an archery finger tab 10. The preferred embodiment of the finger tab 10, as shown in FIGS. 1 through 25, is comprised of a tab face 20 having a front edge 22 and a rear edge 24, with the front edge 22 having an index finger portion 26, a middle and ring finger portion 28, with the front edge 22 of each portion 26 and 28 having a U-shaped slot 30 therebetween. The tab face 20 includes a number of screw clearance holes 32 and a quantity of strap receiving slots 34 adjacent to the rear edge 24, as illustrated in FIG. 7.

The tab face 20 is oversized which permits an archer to custom trim the shape to facilitate an optimum fit. In FIG. 7 the dashed lines depict a possible trim outline which may be cut to fit the outline of the archer's hand and style of release. Preferably, the tab face 20 is made using grain oriented cordovan leather with the grain positioned at a right angle to the front edge 22, thereby permitting the bowstring to follow the grain in a straight direction when the bowstring is released from the tab.

Figure 8:
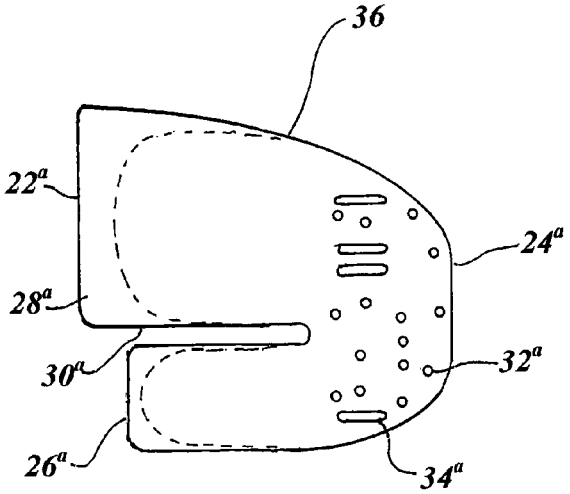
FIG. 8 is a top view of the backing member in the preferred embodiment.

A backing member 36 is sandwiched beneath the tab face 20 and is identical in shape with the tab face 20 except for the material. The backing member 36 includes a front edge $\mathbf{22}^a$ and a rear edge $\mathbf{24}^a$ with the front edge $\mathbf{22}^a$ having an index finger portion $\mathbf{26}^a$, a middle and ring finger portion $\mathbf{28}^a$. The front edge $\mathbf{22}^a$ of each portion $\mathbf{26}^a$ and $\mathbf{28}^a$ has a U-shaped slot $\mathbf{30}^a$ therebetween. The backing member 36 includes a number of screw clearance holes 32$^a$ and a quantity of strap receiving slots 34$^a$ adjacent to the rear edge 24$^a$, as illustrated in FIG. 8.

The backing member 36 is oversized which permits an archer to custom trim the shape to facilitate an optimum fit. In FIG. 8 the dashed lines likewise depict a possible trim outline which may be cut to fit the outline of the archer's hand and style of release. Preferably, the backing member 36 is made of split suede, with the split side of the suede adjacent to the tab face 20, thereby permitting the soft suede side to contact the archer's fingers.

Figure 9:
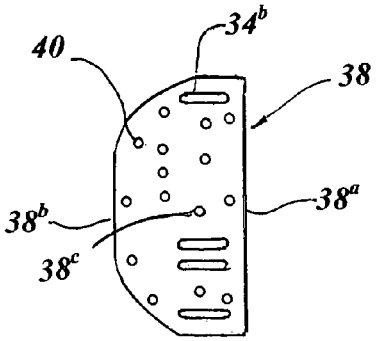
FIG. 9 is a top view of the mounting plate in the preferred embodiment.
Figure 10:
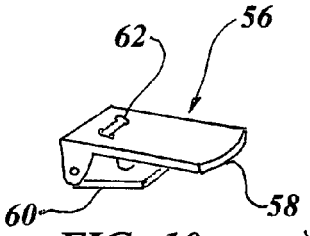
FIG. 10 is a partial isometric view of the snap buckle in the preferred embodiment.
Figure 11:
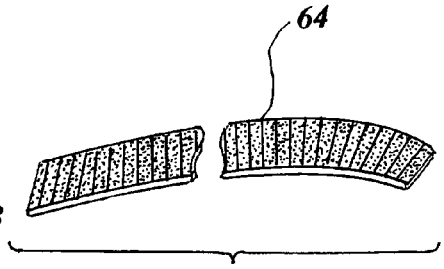
FIG. 11 is an orthographic view of the finger retaining strap in the preferred embodiment.
Figure 12:
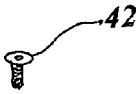
FIG. 12 is a partial isometric view of one of the threaded fastener screws in the preferred embodiment.
Figure 13:
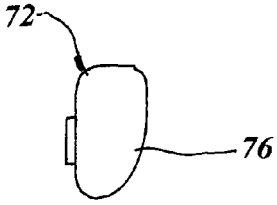
FIG. 13 is a left end view of a reference point ledge in the preferred embodiment.
Figure 14:
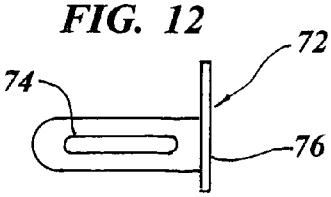
FIG. 14 is a top view of the reference point ledge in the preferred embodiment.
Figure 15:
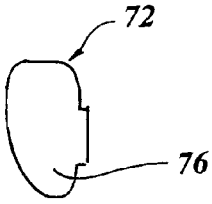
FIG. 15 is a right end view of the reference point ledge in the preferred embodiment.
Figure 16:
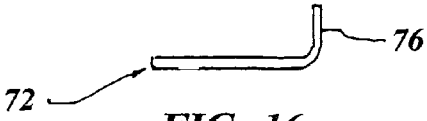
FIG. 16 is a side view of the reference point ledge in the preferred embodiment.

A flat mounting plate 38 having a forward edge 38$^a$, a palm edge 38$^b$ and two finger mounting holes 38$^c$, shown in FIG. 9, is attached jointly to the rear edge 24 of the tab face 20 and the rear edge 24$^a$ of the backing member 36. The mounting plate 38 includes a number of threaded holes 40 and a quantity of strap receiving slots 34$^b$ that line up with the screw clearance holes 32 and 32$^a$ and the strap receiving slots 34 and 34$^a$. The mounting plate 38 is made of aluminum, preferably anodized, and is essentially rectangular in shape with the palm edge 38$^a$ having a shape that conforms to the archer's palm.

The threaded holes 40 permit attachment of the tab face 20 and the backing member 36 by utilizing a plurality of threaded socket-head stainless steel screw fasteners 42. The mounting plate strap receiving slots 34$^b$ are aligned adjacent to a forward edge 38$^a$ of the mounting plate 38 that mates with the tab face and backing member strap receiving slots 34 and 34$^a$.

Figure 1:
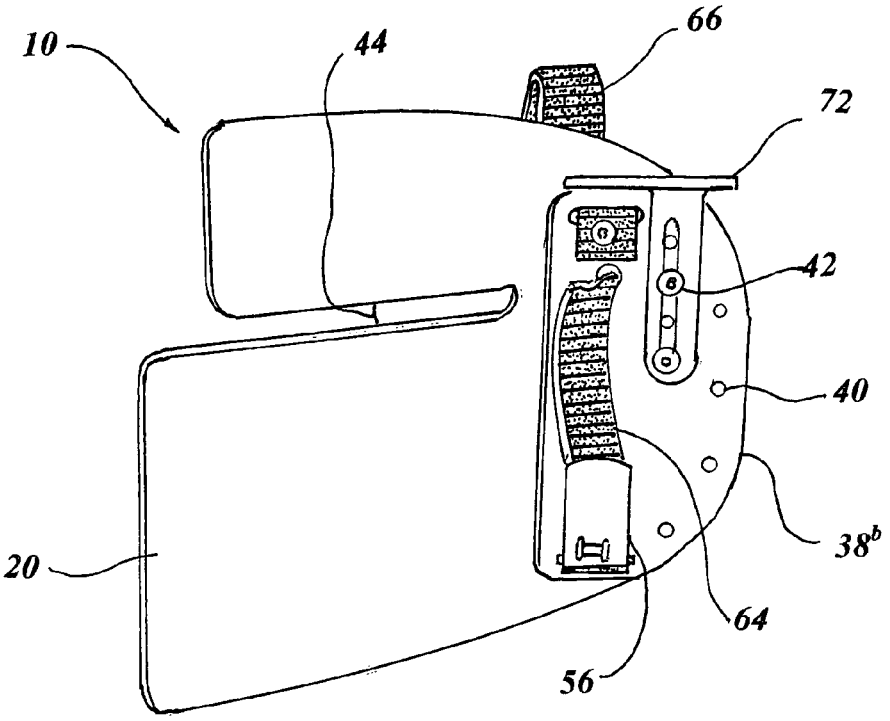
FIG. 1 is a partial isometric top view of the archery finger tab in the preferred embodiment.
Figure 2:
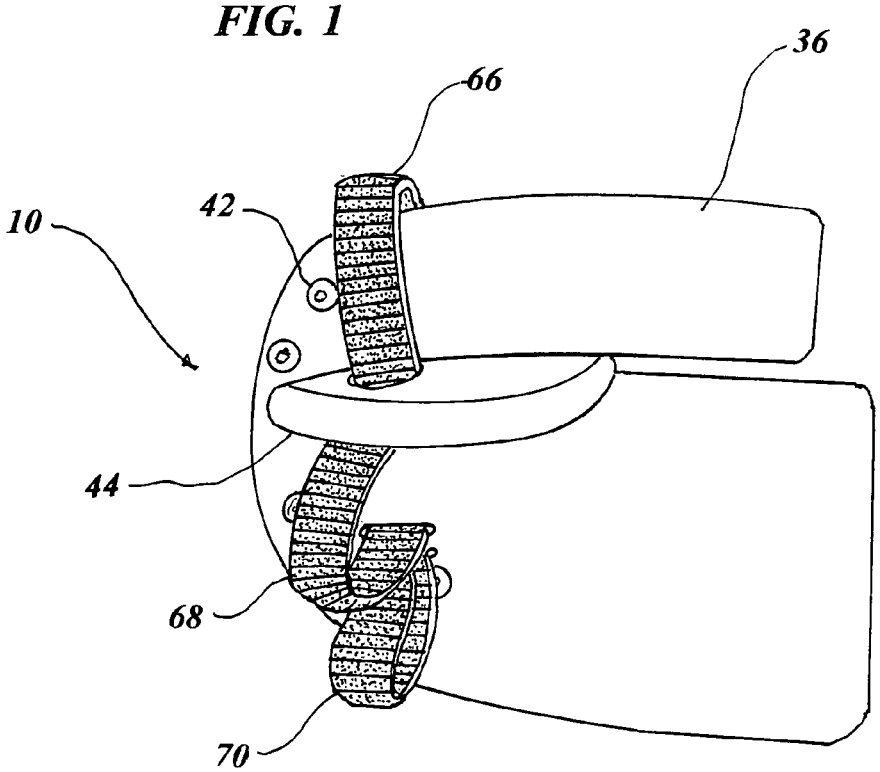
FIG. 2 is a partial isometric bottom view of the archery finger tab in the preferred embodiment.
Figure 3:
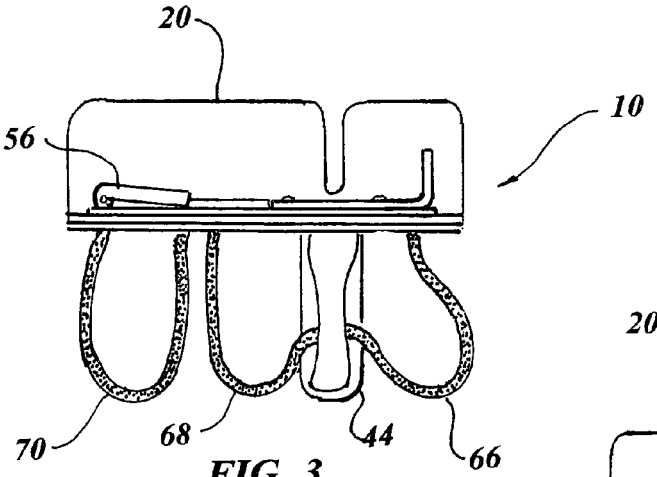
FIG. 3 is a rear view of the archery finger tab in the preferred embodiment.
Figure 4:
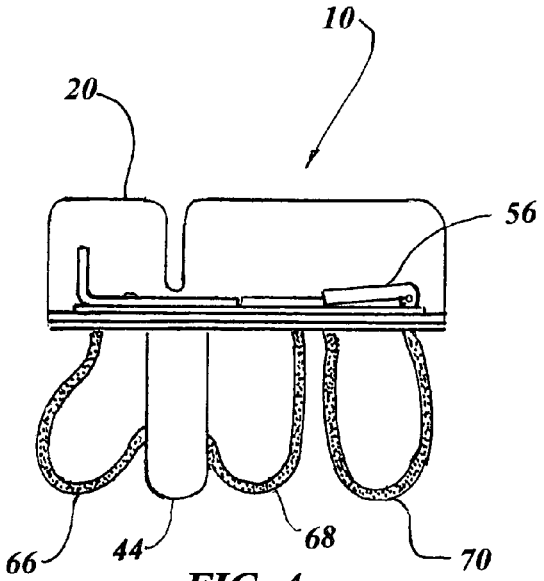
FIG. 4 is a front view of the archery finger tab in the preferred embodiment.
Figure 5:
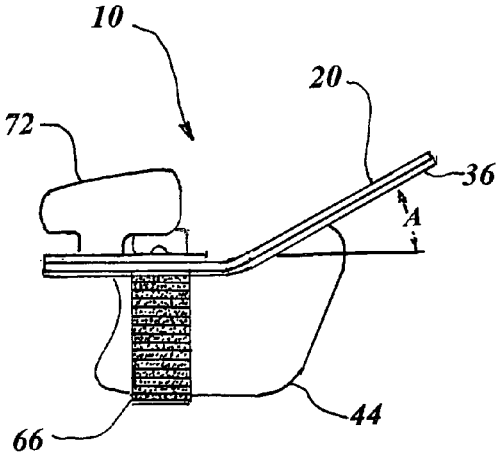
FIG. 5 is a right side view of the archery finger tab in the preferred embodiment.
Figure 6:
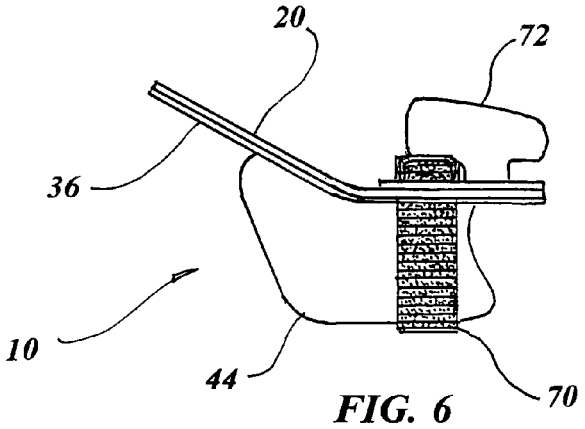
FIG. 6 is a left side view of the archery finger tab in the preferred embodiment.

A finger spacer 44, depicted separately in FIGS. 17-24, is attached to the mounting plate 38 beneath the tab face U-shaped slot 30 and the backing member U-shaped slot 30$^a$, as shown in FIGS. 2 through 4. The finger spacer 44 includes a strap receiving slot 34$^c$ continuing completely through the spacer 44.

The shape of the finger spacer 44 is important to the novelty of the invention, therefore the following profile is clearly defined as follows.

The finger spacer 44 has a leading end 46 and a trailing end 48, with the leading end 46 wider than the trailing end 48 which forms tapered sides 50 starting in the middle. The finger spacer has a corner radius 52 and a hollowed recess 54, illustrated in FIG. 24, located adjacent to the tailing end 48 on each side 50, thereby permitting an archer's fingers to press into the ergonomic designed finger spacer 44 comfortably.

Figure 17:
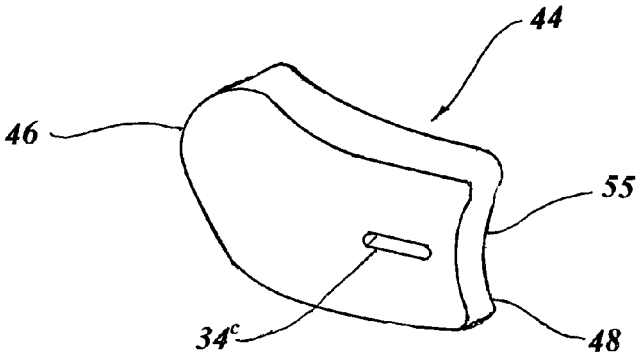
FIG. 17 is a partial isometric view of the finger spacer in the preferred embodiment.
Figure 20:
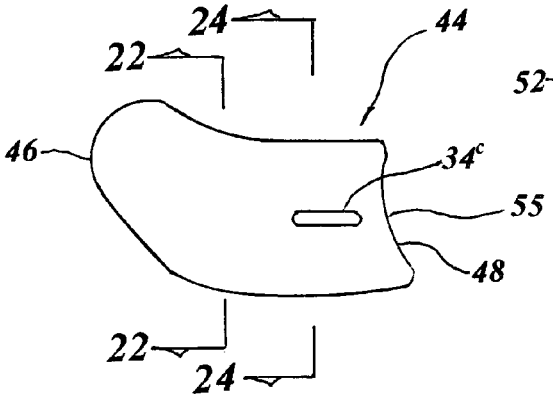
FIG. 20 is a side view of the finger spacer in the preferred embodiment.
Figure 21:
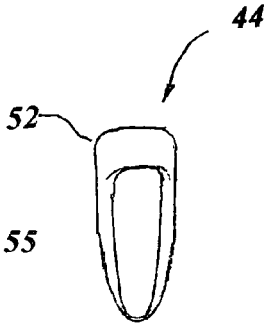
FIG. 21 is a trailing end view of the finger spacer in the preferred embodiment.
Figure 22:
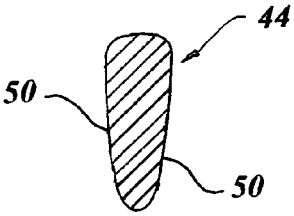
FIG. 22 is a cross-sectional view taken along lines 22-22 of FIG. 20.
Figure 23:
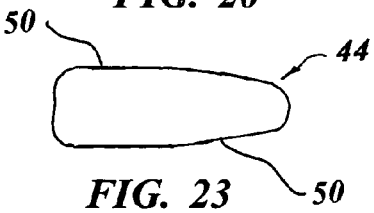
FIG. 23 is a bottom view of the finger spacer in the preferred embodiment.
Figure 24:
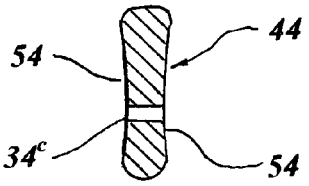
FIG. 24 is a cross-sectional view taken along lines 24-24 of FIG. 20.

The finger spacer 44 includes a crescent shaped contour 55 at its trailing end 48, as illustrated in FIGS. 17 and 20. The strap receiving slot 34$^c$ is positioned adjacent to the trailing end 48 shown in FIGS. 17, 20 and 24.

The leading end 46 of the spacer 44 is configured to have an upward-curved shape similar to the bow of a ship, as illustrated in FIGS. 5, 6, 17 and 20.

The angle of the leading end 46 has an upward angle of 25 degrees to 35 degrees (30 degrees being preferred), leaving a remaining horizontal top surface that is attached to the mounting plate 38 with a treaded screw fastener 42. The use of the 30 degree angle on the leading end 46, depicted as alpha letter "A" in FIG. 5, permits the finger spacer 44 to be positioned closer to the arrow nock when at full draw which overcomes hand torque from the weight of the bow on the archer's fingers.

A snap buckle 56, shown in FIGS. 1-3, 4 and 10, is attached to the mounting plate 38 with a screw fastener 42 at the mounting plate forward edge 38$^a$, adjacent to the tab face middle and ring finger side 28, and between two strap receiving slots 34$^b$. The snap buckle 56 consists of a snap-in cover 58 and a base 60 which includes gripping teeth that are configured to penetrate and retain a strap. A depressed rib 62 in the snap-in cover 58 insures that the cover 58 will not open when an arrow is released due to the shock and vibration.

A finger retaining strap 64, preferably a single piece of ⅜ inch wide nylon webbing or leather, as shown in FIGS. 1-6 and 11, is attached to the mounting plate 38 with a screw fastener 42 adjacent to the mounting plate forward edge 38$^a$ on the tab face index finger portion 26. The strap 64 is threaded through the strap receiving slot 34$^c$ within the finger spacer 44, forming an index finger loop 66. The strap 64 is sequentially threaded through two strap receiving slots 34$^b$ adjacent to the snap buckle 56 right side, forming a middle finger loop 68. Then the strap 64 continues through a final strap receiving slot adjacent to a left side of the snap buckle 56, forming a ring finger loop 70. The strap 64 ends when entering and being captured by the buckle 56, thereby permitting the archery finger tab 10 to be individually adjusted around each of an archer's three fingers. This arrangement keeps the finger tips parallel with a bowstring with the finger spacer, thus preventing the tab 10 from sliding forward at release.

The screw fastener 42 is preferably the socket-head stainless steel screw type that attaches the tab face 20, backing member 36, snap buckle 56 and finger retaining strap 64 to the mounting plate threaded holes 40.

An optional stainless steel reference point ledge 72, as shown in FIGS. 1-6 and 13-16, includes a slot with 90 degree right angle chin mating platform 76 and is attached to the mounting plate threaded holes 40 with screw fasteners 42.

Figure 25:
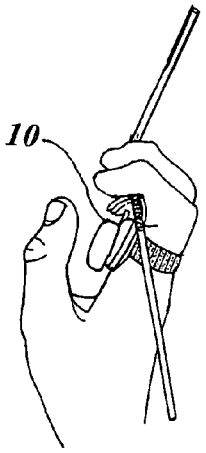
FIG. 25 is a sketch of a shooters hand and finger torque.
Figure 18:
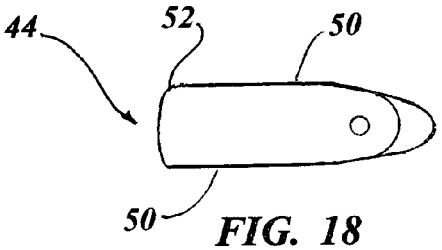
FIG. 18 is a top view of the finger spacer in the preferred embodiment.
Figure 19:
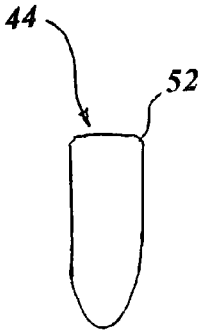
FIG. 19 is a leading end view of the finger spacer in the preferred embodiment.

FIG. 25 illustrates a sketch of a shooters hand and finger torque using the archery finger tab 10.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An archery finger tab for a bowstring which comprises:

a) a tab face having an index finger portion, a middle and ring finger portion and a U-shaped slot, b) a backing member juxtaposed beneath the tab face duplicating a tab face configuration, wherein there is a slot in the backing member, c) a flat aluminum mounting plate attached jointly to a rear edge of the tab face and the backing member, with the mounting plate having four strap receiving slots comprising a first strap receiving slot, a second strap receiving slot, a third strap receiving slot, and a fourth strap receiving slot, d) an independent finger spacer is attached to the mounting plate beneath the U-shaped slot in the tab face and said slot in the backing member, wherein the finger spacer having a strap receiving slot therethrough, and a leading end and a trailing end, with the leading end wider than the trailing end therefore forming tapered sides with each end having a corner radius, said finger spacer also having a hollowed recess adjacent to the trailing end on each side, a crescent shaped contour and said slot are located at said trailing end, with said leading end including a ship's bow upward-curved shape at an angle of 25 degrees to 35 degrees leaving a horizontal bottom attached to said mounting plate, which permits an archer's fingers to press into said finger spacer comfortably, e) a snap buckle attached to the mounting plate, and f) a single finger retaining strap attached to the aluminum mounting plate adjacent to a forward edge of the mounting plate on the tab face index finger portion, said strap threaded through said first strap receiving slot and said strap receiving slot through the finger spacer, forming an index finger loop, the strap continuing through said second and third strap receiving slots adjacent to a right side of the snap buckle, forming a middle finger loop, then continuing into said fourth strap receiving slot adjacent to a left side of the snap buckle, forming a ring finger loop that ends by said strap entering the buckle.

2. An archery finger tab for a bowstring which comprises:

a) a tab face having a front edge and a rear edge, with the front edge having an index finger portion and a middle and ring finger portion, with the front edge having a U-shaped slot between the index finger portion, and the middle and ring finger portion with the tab face having plurality of screw clearance holes and four strap receiving slots adjacent to the rear edge, wherein said tab face is oversized, thereby permitting an end user to custom trim the shape, to facilitate an optimum personalized fit, said tab face is grain-oriented cordovan leather with the grain positioned at right angles to said tab face front edge, thereby permitting a bowstring to follow the grain in a straight direction when a bowstring is released from the tab, b) a backing member juxtaposed beneath the tab face and having a front edge and a rear edge, with the front edge having an index finger portion and a middle and ring finger portion, with the front edge having a U-shaped slot between the index finger portion, and the middle and ring finger portion with the backing member having a plurality of screw clearance holes and a plurality of strap receiving slots adjacent to the rear edge, wherein said backing member is oversized, thereby permitting an end user to custom trim the shape to facilitate an optimum personalized fit, and said backing member is split suede with the split side of the suede adjacent to said tab face, thereby permitting the suede's buffed flesh side to contact an archer's fingers, c) a flat mounting plate having a forward edge and a palm edge attached jointly to the rear edge of the tab face and the rear edge of the backing member, with the mounting plate having a fifteen threaded holes for attachment to said tab face, said backing member also having four strap receiving slots aligned adjacent to said mounting plate forward edge comprising a first strap receiving slot, a second strap receiving slot, a third strap receiving slot, and a fourth strap receiving slot, with said mounting plate made of rigid aluminum having a thickness sufficient to obtain said threaded holes, d) an independent finger spacer is attached to the mounting plate beneath the U-shaped slots in the tab face and the backing member, wherein the finger spacer having a strap receiving slot therethrough, wherein said finger spacer further having a leading end and a trailing end, with the leading end wider than the trailing end therefore forming tapered sides with each end having a corner radius, said finger spacer also having a hollowed recess adjacent to the trailing end on each side, a crescent shaped contour and said slot at said trailing end, with said leading end including a ship's bow, upward-curved shape at an angle of 25 degrees to 35 degrees leaving a horizontal bottom attached to said mounting plate, which permits an archer's fingers to press into said finger spacer comfortably, e) a snap buckle attached to the mounting plate adjacent to the mounting plate forward edge, wherein said snap buckle further having a snap-in cover and a base, and f) a finger retaining strap attached to the mounting plate adjacent to the mounting plate forward edge on the tab face index finger portion, said strap threaded through said first strap receiving slot and said strap receiving slot through the finger spacer, forming an index finger loop, the strap continuing through said second and third strap receiving slots adjacent to a right side of the snap buckle, forming a middle finger loop then continuing into said fourth strap receiving slot adjacent to a left side of the snap buckle, forming a ring finger loop that ends by said strap being captured by the buckle, thereby permitting the archery finger tab to be individually adjusted around each 'of an archer's three fingers, keeping the finger tips parallel with a bowstring with the finger spacer, thus preventing the tab from sliding forward at release.

3. The archery finger tab as recited in claim 2 wherein said aluminum mounting plate is anodized.

4. The archery finger tab as recited in claim 2 wherein said mounting plate is essentially rectangular in shape, with said palm edge having a configuration adapted to conform to an archer's palm.

5. The archery finger tab as recited in claim 2 wherein said finger retaining strap is a single piece of ⅜ inch wide nylon webbing.

6. The archery finger tab as recited in claim 2 further comprising a plurality of threaded socket-head stainless steel screw fasteners for attaching said tab face, said backing member, said snap buckle, said finger spacer and said finger retaining strap to said mounting plate.

7. An archery finger tab for a bowstring which comprises:

a) a tab face having a front edge and a rear edge, with the front edge having an index finger portion and a middle and ring finger portion, with the front edge having a U-shaped slot between the index finger portion and the middle and ring finger portion, with the tab face having plurality of screw clearance holes and four strap receiving slots adjacent to the rear edge comprising a first strap receiving slot, a second strap receiving slot, a third strap receiving slot, and a fourth strap receiving slot, b) a backing member juxtaposed beneath the tab face and having a front edge and a rear edge, with the front edge having an index finger portion and a middle and ring finger portion, with the front edge having a U-shaped slot between the index finger portion and the middle and ring finger portion, with the tab face having a plurality of screw clearance holes and four strap receiving slots adjacent to the rear edge comprising a first strap receiving slot, a second strap receiving slot, a third strap receiving slot, and a fourth strap receiving slot, c) a flat mounting plate having a forward edge and a palm edge attached jointly to the rear edge of the tab face and the rear edge of the backing member, with the mounting plate having a plurality of threaded holes and four strap receiving slots comprising a first strap receiving slot, a second strap receiving slot, a third strap receiving slot, and a fourth strap receiving slot, d) a finger spacer attached to the mounting plate beneath the U-shaped slots in the tab face and the backing member, wherein the finger spacer having a strap receiving slot therethrough, e) a snap buckle attached to the mounting plate adjacent to the mounting plate forward edge, f) a stainless steel reference point ledge having a slot therein and a 90 degree right angle chin mating platform attached to the flat mounting plate and, g) a finger retaining strap attached to the mounting plate adjacent to the mounting plate forward edge on the tab face index finger portion, said strap threaded through said first strap receiving slot of said mounting plate and said strap receiving slot through the finger spacer, forming an index finger loop, the strap continuing through said second and third strap receiving slots of said mounting plate adjacent to a right side of the snap buckle, forming a middle finger loop then continuing into said fourth strap receiving slot of said mounting plate adjacent to a left side of the snap buckle, forming a ring finger loop that ends by said strap being captured by the buckle, thereby permitting the archery finger tab to be individually adjusted around each of an archer's three fingers, keeping the finger tips parallel with a bowstring with the finger spacer, thus preventing the tab from sliding forward at release.

* * * * *